United States Patent [19]

Duda

[11] Patent Number: 4,894,892

[45] Date of Patent: Jan. 23, 1990

[54] METHOD FOR PROCESSING A WARP SHEET OF YARNS

[75] Inventor: Peter Duda, Radevormwald-Herbeck, Fed. Rep. of Germany

[73] Assignee: Barmag, AG, Remscheid, Fed. Rep. of Germany

[21] Appl. No.: 229,014

[22] Filed: Aug. 5, 1988

[30] Foreign Application Priority Data

Aug. 7, 1987 [DE] Fed. Rep. of Germany ..... 3726350

[51] Int. Cl.[4] ..... P02H 5/02; D02J 1/08

[52] U.S. Cl. ..... 28/172; 28/198

[58] Field of Search ..... 28/198, 199, 201, 202, 28/208, 212, 172, 184, 190, 193; 242/131.1; 226/89, 91

[56] References Cited

U.S. PATENT DOCUMENTS

| | | | |
|---|---|---|---|
| 2,096,446 | 10/1937 | Bernhart | 28/199 |
| 2,250,728 | 7/1941 | Sherrill | 28/199 |
| 2,681,496 | 6/1954 | Heckrotte | 28/212 |
| 3,317,979 | 5/1967 | Furst | 28/199 |
| 3,534,921 | 10/1970 | Koslowski | 28/212 X |
| 4,407,767 | 10/1983 | Seaborn . | |
| 4,630,340 | 12/1986 | Bauer et al. . | |
| 4,669,158 | 6/1987 | Ballarati et al. | 28/172 |
| 4,715,097 | 12/1987 | Bogucki-Land | 28/172 |

FOREIGN PATENT DOCUMENTS

| | | | |
|---|---|---|---|
| 3323202 | 12/1983 | Fed. Rep. of Germany . | |
| 2081314 | 2/1982 | United Kingdom | 28/208 |

*Primary Examiner*—Werner H. Schroeder
*Assistant Examiner*—Jodi Tokar
*Attorney, Agent, or Firm*—Bell, Seltzer, Park & Gibson

[57] ABSTRACT

An apparatus for processing an advancing warp sheet of yarns is disclosed, and which includes at least one yarn guide reed which serves to maintain a predetermined lateral separation between the individual yarns of the warp sheet. The reed includes a transverse row of pins which define yarn receiving slots therebetween. To facilitate the thread-up of the warp sheet onto the reed, there is provided an elongate support rail which is positioned parallel to and above the row of pins. During the threading procedure, a first portion of the yarns is withdrawn from their packages and transported along the path of travel of the warp sheet through the apparatus. At each reed, the portion of yarns is laid across the upper surface of the support rail, and the yarns are subsequently transferred from the upper surface of the support rail into individual ones of the yarn receiving slots defined between the pins. A next portion of the yarns is then threaded in the above described manner, and the procedure is repeated until all of the yarns have been threaded onto the apparatus.

3 Claims, 2 Drawing Sheets

METHOD FOR PROCESSING A WARP SHEET OF YARNS

FIELD OF THE PRESENT INVENTION

The present invention relates to an apparatus for guiding an advancing warp sheet of yarns during a yarn processing operation, and to a method for threading the warp sheet of yarns onto the apparatus.

BACKGROUND OF THE INVENTION

Yarns are commonly processed in warp sheet form, such as by drawing and heating the warp sheet while it longitudinally advances. Processes of this type are disclosed in U.S. Pat. No. 4,407,767 to Seaborn, and U.S. Pat No. 4,630,340 to Bauer et al, and German OS No. 3323202.

In a typical process of the above type, the warp sheet contains many yarns, for example more than 100 yarns, and the yarns have a small lateral spacing or gauge. Also, the warp sheet advances onto the draw rolls of a godet having a length for example of about one meter, and the yarns are drawn or subsequently heat treated under a relatively low yarn tension. In this process, it is necessary to guide the yarns of the warp sheet by means of a reed. Such reeds conventionally comprise a plurality of pins aligned in a direction which is transverse to the longitudinal advance of the yarns, and with the pins being separated a uniform distance or gauge and such that adjacent pins define a yarn receiving slot therebetween. The thread-up of such yarn reeds is a time consuming and labor intensive operation and it is accordingly an object of the present invention to provide an apparatus and method for threading the warp sheet onto a reed of the described type, and onto the draw rolls.

SUMMARY OF THE PRESENT INVENTION

The above and other objects and advantages of the present invention are achieved in the embodiments illustrated herein by the provision of an apparatus which comprises a yarn reed which includes an elongate frame member which extends in a transverse direction, and a plurality of pins extending upwardly from the frame member, and with the pins being aligned in the transverse direction and being separated from each other a uniform and predetermined distance so that adjacent pins define a yarn receiving slot therebetween. The apparatus further includes an elongate support rail having an upper yarn support surface extending along its length, and means mounting the support rail for back and forth movement in the transverse direction immediately above the row of pins, and with said upper yarn support surface facing upwardly. By this arrangement, a plurality of yarns may be disposed across the upper yarn support surface of the support rail, and then individually transferred from the support surface into individual ones of the yarn receiving slots which are exposed adjacent one end of the support rail, and while the support rail is moved transversely to expose further ones of said yarn receiving slots.

The apparatus defined above is not only suitable and useful for threading a warp sheet of yarns, but also for threading up individual yarns, such as broken yarns of the sheet.

In a specific embodiment, the method of the present invention is utilized with an apparatus for processing a warp sheet of yarns of the type comprising a yarn delivery creel supporting a plurality of yarn packages, means for advancing the yarns from the yarn creel along a path of travel in a warp sheet while drawing the warp sheet, and a yarn reed positioned along and transversely to the path of travel. The method comprises the steps of positioning an elongate support rail above and parallel to the row of pins, with the support rail having an upper yarn support surface, and withdrawing a first portion of the yarns from the creel and transporting the yarns along the path of travel and across the upper support surface of the support rail. The first portion of yarns is then transferred from the support surface into individual ones of the yarn receiving slots which are exposed adjacent one end of the support rail. These steps are repeated with additional portions of the yarn from the creel, until all of the yarns have been positioned in individual ones of the yarn receiving slots. Also, the method may involve the step of periodically moving the support rail transversely to expose different ones of the yarn receiving slots.

An important feature of the method described above resides in the fact that the warp sheet of yarns is threaded in groups, by initially by-passing the reed, such that the groups are intially supported above the reed and then distributed into the slots of the reed.

The support rail which is positioned above the reed for supporting the groups of yarns may include a groove in its bottom surface, and which extends parallel to the row of pins on the yarn reed, and with the pins being received in the groove such that the support rail is supported by the pins for back and forth transverse movement. The support rail preferably extends transversely over only a portion of the length of the row of pins, so that it can be displaced to any desired extent.

In another specific embodiment, the support rail is characterized in that it is supported in cantilever fashion, and is displaceable in a transverse direction which is parallel to and above the row of pins, and so that the free end of the rail can be moved above the row of pins.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figures 1, 2, 2A:
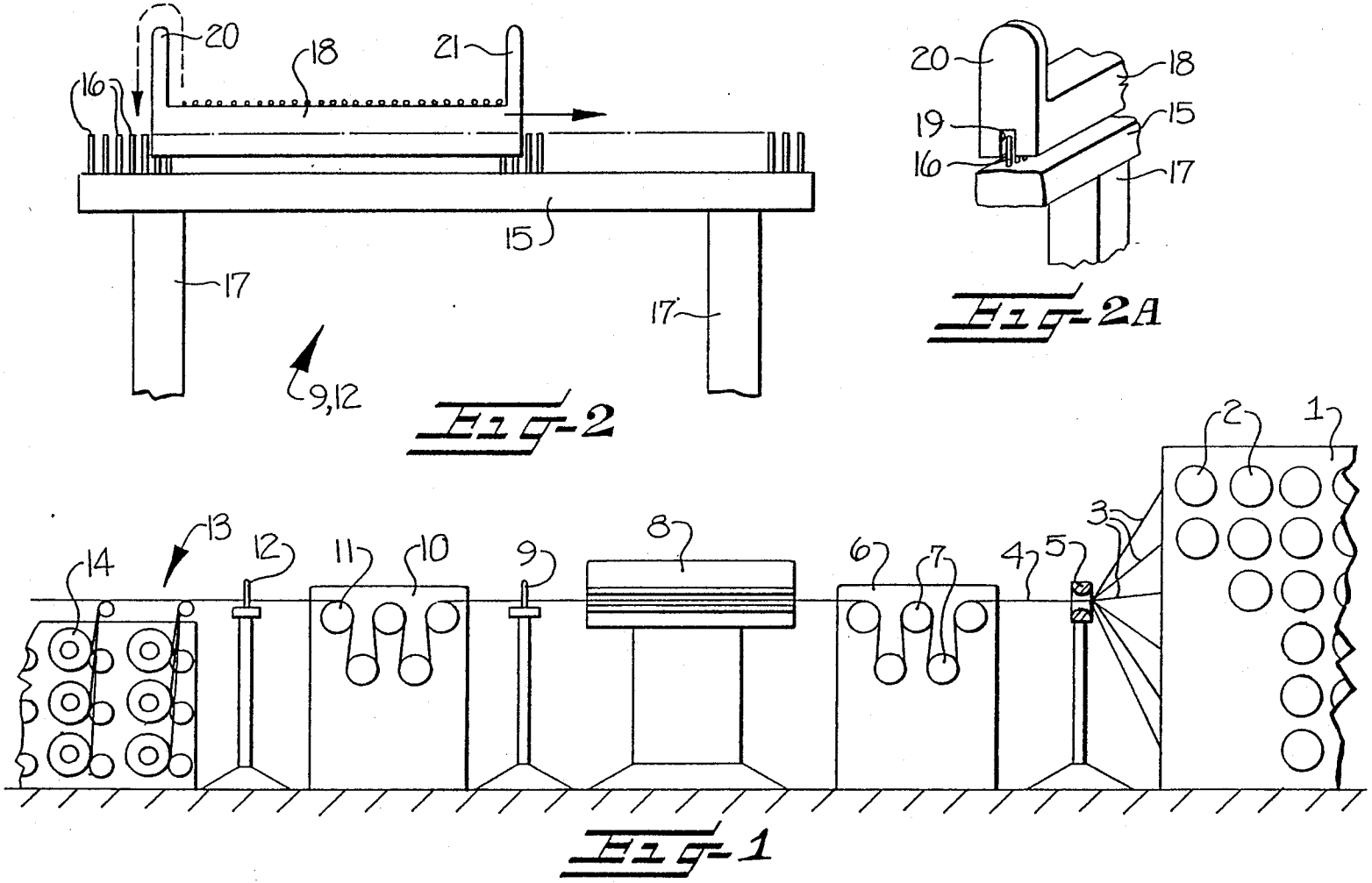
FIG. 1 is a schematic diagram of a yarn processing apparatus which embodies the present invention, and which includes means for drawing and heating a longitudinally advancing warp sheet of yarns.
FIG. 2 is a fragmentary front elevation view of a yarn reed and support rail as employed in the apparatus illustrated in FIG. 1 and in accordance with the present invention.
FIG. 2A is a fragmentary perspective view of one end of the apparatus shown in FIG. 2.

Referring more particularly to the drawings, FIG. 1 illustrates a yarn processing apparatus which includes a creel 1 which is adapted to support a large number of yarn feed packages 2. Typically, a creel of this type can support 100 or more such packages. The yarns 3 are withdrawn overhead with respect to the packages, and are delivered to a threading reed 5. The reed 5 is provided with a plurality of eyelets which are transversely aligned, and each yarn is threaded through an individual one of such eyelets. As a result, a warp sheet of yarns 4 is formed, with the yarns of the warp sheet having a lateral yarn separation or gauge which is predetermined by the separation of the eyelets, and which is typically, for example, about 8 mm.

The warp sheet of yarns 4 then longitudinally advances in a single horizontal plane to a first system of draw rolls 7, which consists of five godet rolls which are supported in cantilever fashion and extend from one side of a supporting frame 6. The yarns loop about the godet rolls 7 in a meandering or sinuous path, and they are then advanced to a heating system 8 positioned adjacent the frame 6. In the heating system 8, the entire warp sheet of yarns is subjected to a heat treatment by means of hot air. A yarn guide reed 9 follows the heating system, the thread-up and the construction of which will be described in greater detail below. The yarn guide reed 9 serves the purposes of maintaining the gauge between the yarns in the subsequent system of draw rolls 11, which comprises five such rolls which are supported in cantilever fashion and mounted on one side of the supporting frame 10. The rolls 7 and 11, or some of these rolls, may be heated.

The second draw system of the rolls 11 is followed by still another yarn guide reed 12, from which the yarns are distributed to the take-up devices 14 which are arranged in a creel 13. The thread-up and the construction of the yarn guide reed 12 will also be described below.

Figure 3:
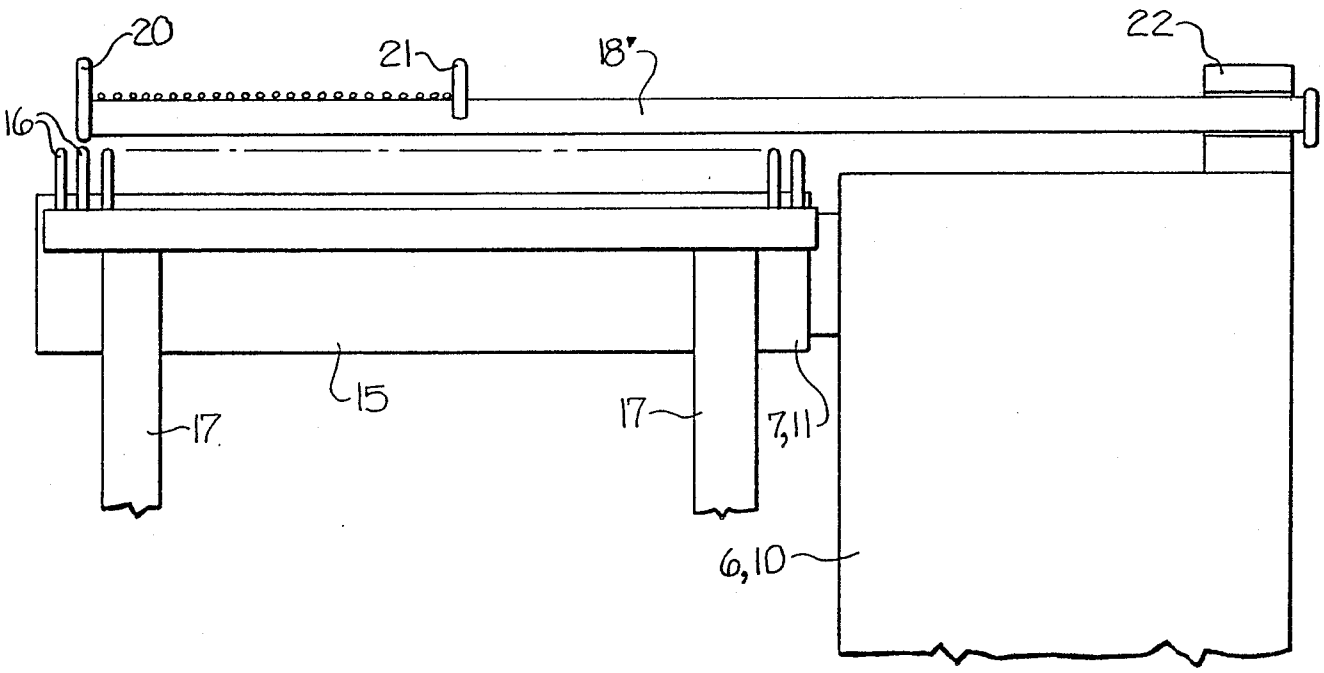
FIG. 3 is a fragmentary front elevation view of a second embodiment of a yarn reed and support rail in accordance with the present invention.

FIGS. 2 and 3 illustrate the construction of the reed 9, which is the same as the reed 12. The reed 9 comprises an elongate frame member 15 which is horizontal and extends in a transverse direction with respect to the longitudinally advancing warp sheet 4. The upper side of the frame member 15 mounts a plurality of pins 16 which extend upwardly from the frame member. Also, the pins are aligned in the transverse direction, and they are separated from each other a uniform and predetermined distance so that adjacent pins define a yarn receiving slot therebetween which corresponds to the predetermined gauge. Also, the number of pins 16 corresponds to the number of yarns being processed, plus one. The pins 16 project into the plane of the advancing warp sheet of yarns and so as to maintain their separation. The horizontal frame member 15 is supported on vertical stands 17, and the elevation of the frame member 15 will thus determine the elevation of the plane of the advancing yarns.

An elongate support rail 18 is positioned above and parallel to the row of pins 16. The support rail 18 includes a flat upper yarn support surface which extends along the length of the rail 18 and which is bordered by end posts 20 and 21. The support rail also includes a downwardly facing bottom surface, and a groove 19 in the bottom surface which extends along the entire length of the rail. The groove 19 has a width which corresponds closely to the thickness of the pins 16, and the depth of the groove 19 is less than the height of the pins 16. As a result, the support rail 18 is supported by the row of pins and is adapted to be movable back and forth in the transverse direction. Further, the bottom surface is spaced above the frame member 15 a distance sufficient to permit the yarns to pass therebetween without hinderance. The minimum length of the support rail 18 is equivalent to the distance between the pins 16 of the frame member, and the support rail can be positioned in such a way that portions of the frame member with the yarn receiving slots are uncovered from the upper side by transversely moving the support rail.

To describe the method of threading the apparatus disclosed in FIG. 1, a length of all of the yarns 3 is withdrawn from the feed packages 2, which are supported in the creel 1, and each yarn is individually threaded through the eyelets of the threading reed 5. Since the yarns do not yet advance, there is sufficient time to perform this operation. A first group of yarns is then grasped at a location on the left side of the threading reed 5 as seen in FIG. 1, for example with the aid of a hand held suction gun, and this first group of yarns is thereby withdrawn from the creel and advanced through the threading reed 5. The group of yarns is then guided by the suction gun in a meandering or sinuous path about the godet roll 7 of the first draw system. Next, the group is guided through the heating system 8, over the support rail 18 which is above the reed 9, then through the draw system 11 and over the support rail 18 of the reed 12. The group is then singled and individually delivered to the take-up devices 14. The yarns of this first group then advance and are heated, drawn, and wound. As will be seen, waste occurs only during the time between the first grasping of the yarns by the suction gun and the threading of the individual yarns onto the take-up devices 14.

To complete the thread-up process of this first group of yarns, the yarn which is adjacent the end post 20 of the support rail can be raised over the post 20 and placed into the first yarn receiving slot between the two pins of the reed 9, note the dashed arrow in FIG. 2. The support rail is then somewhat transversely displaced, and the next yarn can then be raised and placed into the next yarn receiving slot. Once all of the yarns are thus removed from the support rail of both of the reeds 9 and 12, the above steps are repeated, i.e., another group of yarns is grasped at a location immediately downstream of the threading reed 5 and threaded along the path of travel in the described manner.

In the same manner, any broken yarns may be rethreaded. More particularly, a broken yarn may be grasped downstream of the threading reed 5 by means of a hand operated suction gun. The yarn may then be looped about the draw rolls 7, guided through the heating system 8, placed on the support rail 18 above the reed 9, looped about the draw rolls 11, placed upon the support rail 18 above the reed 12, and then threaded onto one of the take-up devices 14. The yarn then advances, and the yarn can be returned to the area of its original location by displacing the support rails 18 in the transverse direction. The yarn is then lifted over one of the end posts of the support rails and placed into the proper yarn receiving slot.

FIG. 3 illustrates an alternative embodiment of the present invention. In this embodiment, the support rail is supported in cantilever fashion by means of an arm 18' which is mounted to the supporting frame 6 or 10 by means of a guideway 22. The guideway 22 permits the arm 18' to be displaced in the transverse direction. The yarns which are positioned on the support rail may then be lifted over the post 20 at the free end, and placed in the proper yarn receiving slot.

In the drawings and specification, there has been set forth a preferred embodiment of the invention, and although specific terms are employed, they are used in a generic and descriptive sense only and not for purposes of limitation.

I claim:

1. A method of threading a longitudinally extending warp sheet of yarns onto a yarn reed of the type comprising an elongate frame member which extends in the transverse direction, and a plurality of pins extending upwardly from said frame member, and with the pins being aligned in the transverse direction and being separated a uniform and predetermined distance so that adjacent pins define a yarn receiving slot therebetween, and comprising the steps of positioning an elongate support rail in an operative position above and parallel to said row of pins, with said support rail covering a portion of the length of said row of pins and having an upper yarn support surface extending along its length, positioning a plurality of longitudinally extending yarns across said upper yarn support surface while said support rail is in said operative position, and then transferring the yarns from said support surface into individual ones of said yarn receiving slots which are exposed adjacent one end of said support rail, and while periodically moving the support rail transversely to expose further ones of said yarn receiving slots.

2. A method of threading longitudinally extending yarns onto an apparatus for processing a warp sheet of yarns of the type which comprises a yarn delivery creel supporting a plurality of yarn packages, means for advancing the yarns from said creel along a longitudinal path of travel in the form of a warp sheet and while drawing the warp sheet, and at least one yarn reed positioned along said path of travel and comprising an elongate frame member which extends in the transverse direction, and a plurality of pins extending upwardly from said frame member, with said pins being aligned in the transverse direction and being separated from each other a uniform and predetermined distance so that adjacent pins define a yarn receiving slot therebetween, said method comprising the steps of (a) positioning an elongate support rail above and parallel to said row of pins, with said support rail covering a portion of the length of said row of pins and having an upper yarn support surface extending along its length, (b) withdrawing a portion of the yarns from said creel and transporting the same along said path of travel and across said yarn support surface of said support rail, (c) transferring the withdrawn portion of the yarns from said support surface into individual ones of said yarn receiving slots which are exposed adjacent one end of said support rail, and while periodically moving the support rail transversely to expose further ones of said yarn receiving slots, and then (d) repeating steps (b) and (c) until all of the yarns from the creel have been positioned in individual ones of said yarn receiving slots.

3. A method of threading longitudinally extending yarns onto an apparatus for processing a warp sheet of yarns of the type which comprises a yarn delivery creel supporting a plurality of yarn packages, a threading reed positioned adjacent said creel, means for advancing the yarns from said creel and through said threading reed and along a longitudinal path of travel in the form of a warp sheet and while drawing the warp sheet, and at least one yarn guide reed positioned along said path of travel and comprising an elongate frame member which extends in the transverse direction, and a plurality of pins extending upwardly from said frame member, with said pins being aligned in the transverse direction and being separated from each other a uniform and predetermined distance so that adjacent pins define a yarn receiving slot therebetween, said method comprising the steps of (a) positioning an elongate support rail above and parallel to said row of pins of said guide reed, with said support rail covering a portion of the length of said row of pins and having an upper yarn support surface extending along its length, (b) threading all of said yarns through said threading reed, (c) withdrawing a portion of the yarns at a location on the side of said threading reed opposite said creel and so that the portion of the yarns is withdrawn from said creel and advanced through said threading reed, and transporting the same along said path of travel and across said yarn support surface of said support rail, (d) delivering each of the withdrawn yarns to an individual winding device, (e) transferring the withdrawn yarns from said yarn support surface into individual ones of said yarn receiving slots which are exposed adjacent one end of said support rail, and while periodically moving the support rail transversely to expose further ones of said yarn receiving slots, and then (f) repeating steps (c), (d) and (e) until all of the yarns from the creel have been delivered to an individual winding device and positioned in individual ones of said yarn receiving slots.

* * * * *